US011638502B2

(12) United States Patent
Campbell

(10) Patent No.: US 11,638,502 B2
(45) Date of Patent: May 2, 2023

(54) CLEANSING BAR REUSAGE SYSTEM

(71) Applicant: Sarah Campbell, Avondale, PA (US)

(72) Inventor: Sarah Campbell, Avondale, PA (US)

( * ) Notice: Subject to any disclaimer, the term of this patent is extended or adjusted under 35 U.S.C. 154(b) by 0 days.

(21) Appl. No.: 17/396,963

(22) Filed: Aug. 9, 2021

(65) Prior Publication Data

US 2022/0061596 A1 Mar. 3, 2022

Related U.S. Application Data

(60) Provisional application No. 63/071,603, filed on Aug. 28, 2020.

(51) Int. Cl.

| | |
|---|---|
| ***A47K 5/12*** | (2006.01) |
| ***B05B 15/25*** | (2018.01) |
| ***B05B 11/00*** | (2023.01) |

(52) U.S. Cl.

CPC ..... *A47K 5/1205* (2013.01); *A47K 5/1211* (2013.01); *B05B 11/0002* (2013.01); *B05B 15/25* (2018.02); *A47K 2005/1218* (2013.01)

(58) Field of Classification Search

CPC ..... A47K 5/1205; A47K 5/1211; A47K 2005/1218; A47K 5/1201; A47K 5/13; B05B 11/0002; B05B 15/25; B05C 17/00506; B05C 17/00513; B65D 25/48; B65D 47/2018; B65D 47/2062; C11D 13/00; C11D 13/10; C11D 13/30

See application file for complete search history.

(56) References Cited

U.S. PATENT DOCUMENTS

| | | | | | |
|---|---|---|---|---|---|
| 177,351 | A | * | 5/1876 | Ochs | B65D 47/248 222/518 |
| 2,326,641 | A | * | 8/1943 | Heeter | B67D 1/0425 222/545 |
| 2,681,752 | A | * | 6/1954 | Jarrett | B65D 83/48 222/545 |
| 2,751,127 | A | * | 6/1956 | Mitton | A47K 5/12 222/386.5 |
| 5,876,769 | A | * | 3/1999 | Dowden | C11D 13/30 425/398 |

(Continued)

FOREIGN PATENT DOCUMENTS

| | | | |
|---|---|---|---|
| CN | 203144375 U | * | 8/2013 |
| CN | 203341214 U | * | 12/2013 |

(Continued)

*Primary Examiner* — Donnell A Long

(74) *Attorney, Agent, or Firm* — Brennan, Manna & Diamond, LLC

(57) ABSTRACT

The present invention relates to an upcycling system for recycling fragments of solid personal care products. The system includes a dispensing device and a method that allows an individual to turn personal care bar fragments into a liquid cleansing solution that can then be dispensed from the device. The dispenser has at least one suction cup and a removable hook to allow it to easily be stored within a shower. Further, the dispenser has a spout and a push-button assembly that controls the flow of liquid soap from the spout. The method allows a user to place a personal cleansing bar fragment into the device and add a warm liquid to turn the fragment into a liquid cleansing solution that can then be poured from the dispenser.

18 Claims, 4 Drawing Sheets

(56) References Cited

U.S. PATENT DOCUMENTS

| | | | | |
|---|---|---|---|---|
| 5,968,390 | A * | 10/1999 | Lister | C11D 13/00 219/432 |
| 8,157,131 | B2 * | 4/2012 | Sim | B05B 11/0081 222/129 |
| 2006/0179562 | A1 * | 8/2006 | Huber | A47K 5/12 4/628 |
| 2009/0206110 | A1 * | 8/2009 | Bianchini | A47K 5/12 222/181.3 |
| 2021/0401201 | A1 * | 12/2021 | Forutanpour | A47G 19/2272 |

FOREIGN PATENT DOCUMENTS

| | | | |
|---|---|---|---|
| CN | 104939717 A | * | 9/2015 |
| CN | 206315031 U | * | 7/2017 |

* cited by examiner

CLEANSING BAR REUSAGE SYSTEM

CROSS-REFERENCE TO RELATED APPLICATION

The present application claims priority to, and the benefit of, U.S. Provisional Application No. 63/071,603, which was filed on Aug. 28, 2020 and is incorporated herein by reference in its entirety.

FIELD OF THE INVENTION

The present invention relates generally to the field of cleansing products. More specifically, the present invention relates to a soap bar reusage system. The system is comprised of a soap or other cleansing product dispensing device and a method that allows a user to turn soap bar fragments or other cleansing products that are provided in a bar or solid form such as shaving and shampoo bars, into a liquid solution that can then be dispensed from the device. The dispenser has at least one suction cup and a removable hook to allow it to easily be stored within a shower, on a wall near a sink or other locations where the dispenser may be helpful. Further, the dispenser includes a spout and a push-button assembly that controls the flow of a liquid solution from the spout. Further, the method allows a user to place fragments of the formerly solid form of the soap into the device and add warm water to turn the fragments into a liquid solution that can then be poured from the dispenser and used to wash the hands, body, face and hair of the user. Accordingly, the present disclosure makes specific reference thereto. Nonetheless, it is to be appreciated that aspects of the present invention are also equally applicable to other like applications, devices and methods of manufacture.

BACKGROUND OF THE INVENTION

In 2020, 71 million Americans used soap bars and other solid forms of cleansing products for personal cleaning. However, after prolonged usage, the solid form cleaning product, such as soap bars, withers to a small piece creating a fragment that is difficult to use because of its small size, which also makes it harder to grip. As a result, many individuals simply discard this fragment and use a new, full soap bar or other solid cleansing product. However, this discarding of fragments is extremely wasteful, as a user is not getting the complete value out of each product they purchase when they discard a portion of the bar they deem to be "unusable" because of its small size and reduced surface area for creating a lather.

Currently, there is no system or device known in the art that allows the upcycling of consumer cleansing products to utilize the last portion of a soap bar or other solid form cleansing bar. Therefore, there exists a long-felt need in the art for a system and device that allows an individual to utilize the remaining fragment or pieces of a solid cleansing bar product that is otherwise typically deemed "unusable" by the individual. Further, there exists a long-felt need in the art for a system and device that allows an individual to easily use the remaining portion of the product for cleaning and washing. Finally, exists a long-felt need in the art for a system and device that allows a user to easily apply the remaining fragments or pieces of cleansing products to their body. The device can be placed in a shower or other areas where personal cleaning products are dispensed for convenience purposes.

The subject matter disclosed and claimed herein, in one embodiment thereof, comprises a personal cleansing bar reusage system. The system includes a cleansing solution dispensing device and a method of reusing a fragment or other pieces of a personal cleansing bar product to form a liquid solution. The personal cleansing dispensing device has a water-resistant or waterproof dispenser that further includes a dispensing spout. Using a method of reusing a fragment or pieces of a solid personal cleansing bar product to form liquid cleansing solution, a user can then place product fragments into the container, fill the container with warm water, and close the lid of the dispenser. Then, once the hot water melts the pieces or fragments into liquid form, a user can then use the spout of the dispenser to apply the now liquid cleansing product to his or her hands, body, face and hair. The dispenser includes a reservoir to hold the fragments and the base and or sides of the reservoir may be provided with projections which can help break up the fragments when the dispenser is shaken.

In this manner, the personal cleansing bar reusage system of the present invention accomplishes all of the forgoing objectives and provides a system wherein a user can reuse fragments of solid cleaning products that would otherwise be unused and thrown away. Therefore, the system provides a way to upcycle a product and avoids the unnecessary waste of a still functional cleansing bar fragment. Further, the system ensures a user gets the full amount of value out of the personal cleaning product that was purchased.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, is a solid cleansing bar reusage system. The system includes a soap dispensing device and a method of reusing bits, pieces and fragments of a personal care bar or product to form a liquid solution. The dispensing device preferably includes a water-resistant or waterproof plastic body that contains a side surface with a plurality of indentations that allow a user to better grip the container. The body further includes a body surface that has a textured rubber base that prevents the device from sliding on wet surfaces. The body also has a lid assembly that contains male and female or mating lid components, with each component having threads or cooperating snap fitting engagement elements that allow the lid assembly to be secured upon the container. The male lid component may also include a spout. The spout can be opened or closed via a push button assembly on the top surface of the male lid. Accordingly, the push button assembly controls an internal spout gate such that the flow of liquid soap solution from the interior cavity of the body can be allowed or inhibited via pressing or releasing the button. Further, the body may include a plurality of features that allow it to be stuck to a shower wall or from a shower caddy, such as at least one suction cup and a removable hook. In addition, the interior of the container has a reservoir area for holding the solution, and may also include a plurality of protuberances so that the container can be shaken to help break up the bits and pieces in order to create the solution.

Further, the system includes a method of reusing fragments, bits and pieces of soap bars or other solid cleansing bars to form liquid soap. The first step of the method requires placing at least one cleansing bar fragment or bit into the interior cavity of the dispensing device. Next, the second step involves adding warm/hot water to the interior cavity. In the third step, a user must then wait for the water to melt the fragment(s) into liquid soap. Alternatively, the user can shake the container to break up the bits and pieces through use of an agitating action and potentially the use of protuberances in the base of the container. In the fourth step, the user can then pick up and tilt the dispensing device by grabbing the body and pressing down the push button to allow the liquid solution to flow onto his or her hand or body for washing and cleaning.

Accordingly, the improved cleansing bar reusage system of the present invention is particularly advantageous as it allows a user to get value out of the remaining fragments, bits or pieces of a cleansing bar. This then prevents a user from wasting the fragments, bits and pieces and ensuring that they obtain the full value they paid for when using a solid cleansing bar. Further, the dispensing device and method provide an easy way to convert fragments, bits and pieces into a liquid soap or cleansing solution, making it extremely usable, economical and desirable for users.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE INVENTION

Figure 1:
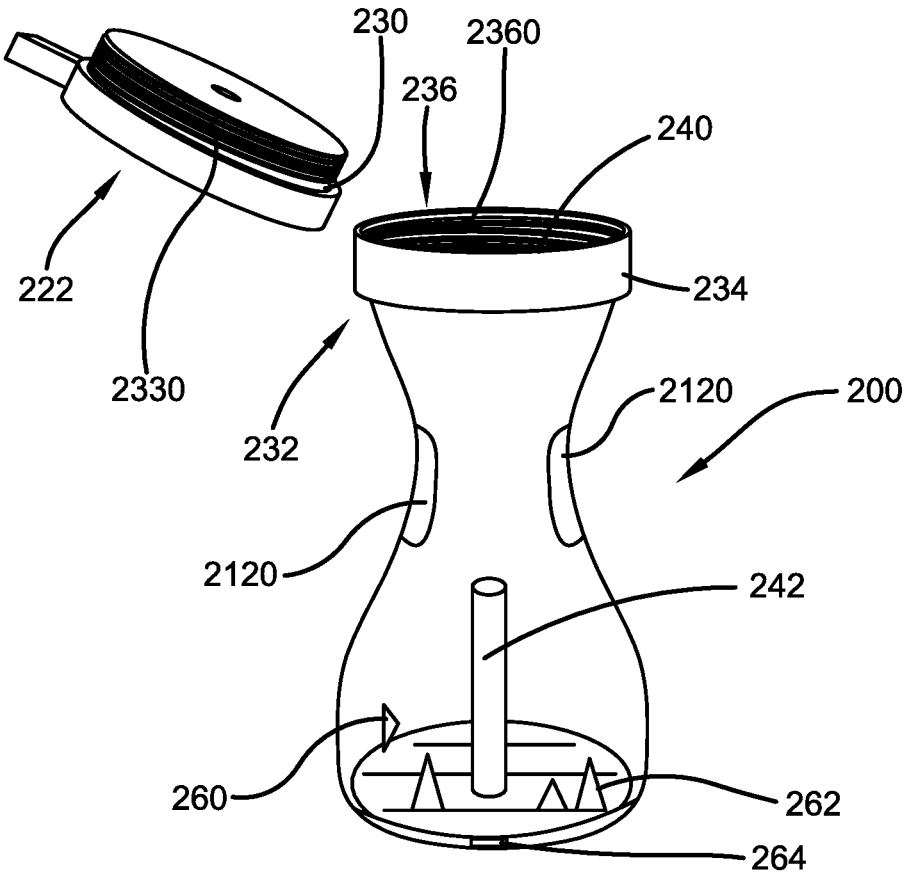
FIG. 1 illustrates a perspective view of one potential embodiment of a liquid cleaning solution dispensing device of the solid cleansing bar reusage system of the present invention in an opened position in accordance with the disclosed structure.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a system and device that allows a user to utilize the remaining portion of solid cleansing bar fragments, bits and pieces that would otherwise by thrown out for being "unusable." Further, there exists a long-felt need in the art for a system and device that allows a user to easily apply the remaining portion of a solid cleansing bar of soap, shampoo, shaving bar or the like to their body. Finally, there exists a long-felt need in the art for a system and device that allows a user to easily apply the remaining portion of a solid cleansing bar to their body. In addition, the system can be used in a shower or placed on a wall for convenient access.

The present invention, in one exemplary embodiment, is comprised of a liquid cleansing bar reusage system that further includes a cleaning solution dispensing device and a method of reusing fragments, bits and pieces of a cleansing bar to form a liquid cleansing solution. The dispensing device preferably has a water-resistant or waterproof plastic body that contains a reservoir, a side surface with a plurality of indentations that allow a user to better grip the device, as well as a textured rubber base that prevents the device from sliding on wet surfaces. The body also includes a lid assembly that has male and female lid components. Each component is further comprised of threads or cooperating snap elements that allow the lid assembly to be secured upon the container. The male lid component further includes a spout that can be opened or closed via a push button assembly or other actuator on the top surface of the male lid that controls an internal spout gate such that the flow of the liquid cleaning solution from the interior cavity of the body can be allowed or inhibited by pressing the button. Further, the body may have a plurality of features that allow it to be secured to a shower wall or from a shower caddy, or other wall in a bathroom, with at least one suction cup and a removable hook.

The system also includes a method of reusing fragments, bits or pieces of a solid cleansing bar to form a liquid cleansing solution such as soap. The first step of the method requires placing at least one fragment into the interior cavity of the dispensing device so that the fragment or other bits and pieces are in the reservoir. The second step involves adding warm or hot water to the interior cavity. In the third step, a user must then wait for the water to melt the fragment(s) into a liquid cleansing solution. Finally in the last step, the user can then pick up and tilt the dispensing device by grabbing the body and pressing down the push button or other actuator to allow the liquid cleansing solution to flow onto his or her hand or body for washing or cleaning.

Therefore, the improved solid cleansing bar reusage system of the present invention allows an individual to use the remaining fragments, bits and pieces of a solid cleansing bar, such as a soap bar, shampoo bar or shaving bar, that would otherwise be discarded. As a result, the system prevents a user from wasting the fragments and ensures that the individual obtains the full value he or she paid for when purchasing a solid cleansing bar. Further, the dispensing device and method provide an easy way to convert solid cleansing bar fragments into a liquid solution for reuse, making it extremely usable and desirable for users.

Figure 4:
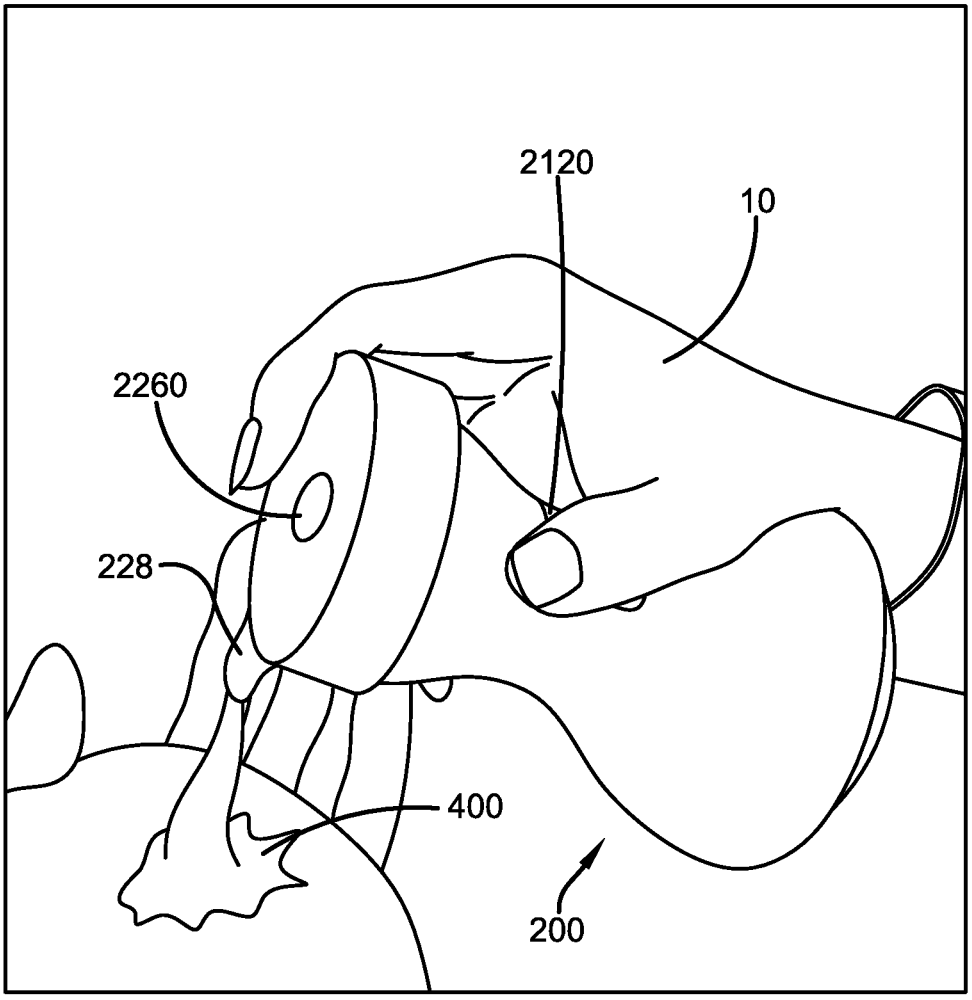
FIG. 4 displays a perspective view of one potential embodiment of a cleansing solution dispensing device of the solid cleansing bar reusage system of the present invention in a closed position showing a user pouring liquid soap out of the device in accordance with the disclosed structure.

Referring initially to the drawings, FIG. 1 illustrates a perspective view of one potential embodiment of a liquid cleansing solution dispensing device 200 of the solid cleansing bar reusage system 100 of the present invention in an opened position. The system 100 preferably includes a soap dispensing device 200 and a method of reusing fragments, bits or pieces 12 of a solid cleansing bar to form a liquid cleaning solution 400 (see FIG. 4). The liquid cleaning solution dispensing device 200 is constructed from a water-resistant or waterproof, rigid plastic body 210. The body 210 further includes a continuous side surface 212 (see FIG. 2) which may contain a plurality of indentions 2120 that may be textured or non-textured to allow the hand 10 of a user to better grip the container 200. Further, the side surface 212 may have at least one integrated suction cup 2122 that allows the device 200 to be temporarily adhered to the wall of a shower or near a sink or other area where people may wash up. Further, the side surface 212 may also have a removable magnetic hook 2124 that attaches to the side surface 212 via a magnetic plate 2126 which allows the device 200 to be supported from a shower head or attached to a shower caddy or other personal accessory that may be used in a bathroom or other cleansing area. To this effect, both the at least one suction cup 2122 and removable hook 2124 allow the dispenser 200 to easily be used within a shower while bathing.

The body 210 also includes a bottom surface 214. The bottom surface preferably has a textured rubber base 2140 which has a plurality of rubber nubs 2142 that allows the container 200 to remain stable and upright when placed on a countertop, and to prevent the device 200 from sliding on wet surfaces (e.g., such as within a shower or on another surface). It is also contemplated that in differing embodiments of the system 100, the container 200 may have a suitable plastic material including but not limited to: acrylic, polycarbonate, polyethylene, thermoplastic, acrylonitrile butadiene styrene, low density polyethylene, medium density polyethylene, high density polyethylene, polyethylene terephthalate, polyvinyl chloride, polystyrene, polylactic acid, acetal, nylon, fiberglass, etc. The body 210 of the container may further be of any suitable shape such that it easily fits in the hand 10 of a user, however the preferred shaped of the body 210 is an hour-glass-like shape, as shown in the FIGS.

As also seen in FIG. 1., the body 210 includes a lid assembly 220. The lid assembly 220 has a plurality of components such as a male lid component 222 and a female lid component 232. The female lid component 232 is preferably fixedly attached to the body 210 and has a rigid, plastic protective outer surface or side surface 234 and an inner surface 236. The inner surface 236 further contains a plurality of female threads or snaps 2360 which can be engagingly received by the male lid component 222. Accordingly, the bottom surface 230 of the male lid component 222 has a male threaded member or snap 2330 that extends downward (e.g. away from) the bottom surface 230 such that it can be received by the female threads or corresponding snap 2360 of the female lid component 232. In this respect, each pair of threads 2330, 2360 allows the male lid component 222 and female lid component 232 to be twisted or snapped together such that any liquid cleansing solution 400 contained within the interior cavity 240 of the body 210 does not leak from the interior cavity 240 unintentionally. FIG. 1 also shows a series of protuberance 260, 262 which are on the interior of the container and can be used to provide agitation to help in breaking up the pieces or fragments of the solid cleansing bar. The container may also be provided with heating elements 265 and a plug 264 to allow the container to be plugged in to an electrical outlet to help with the melting of the fragments or pieces of the solid cleansing bar, or the remelting of the solution if it hardens.

Figure 2:
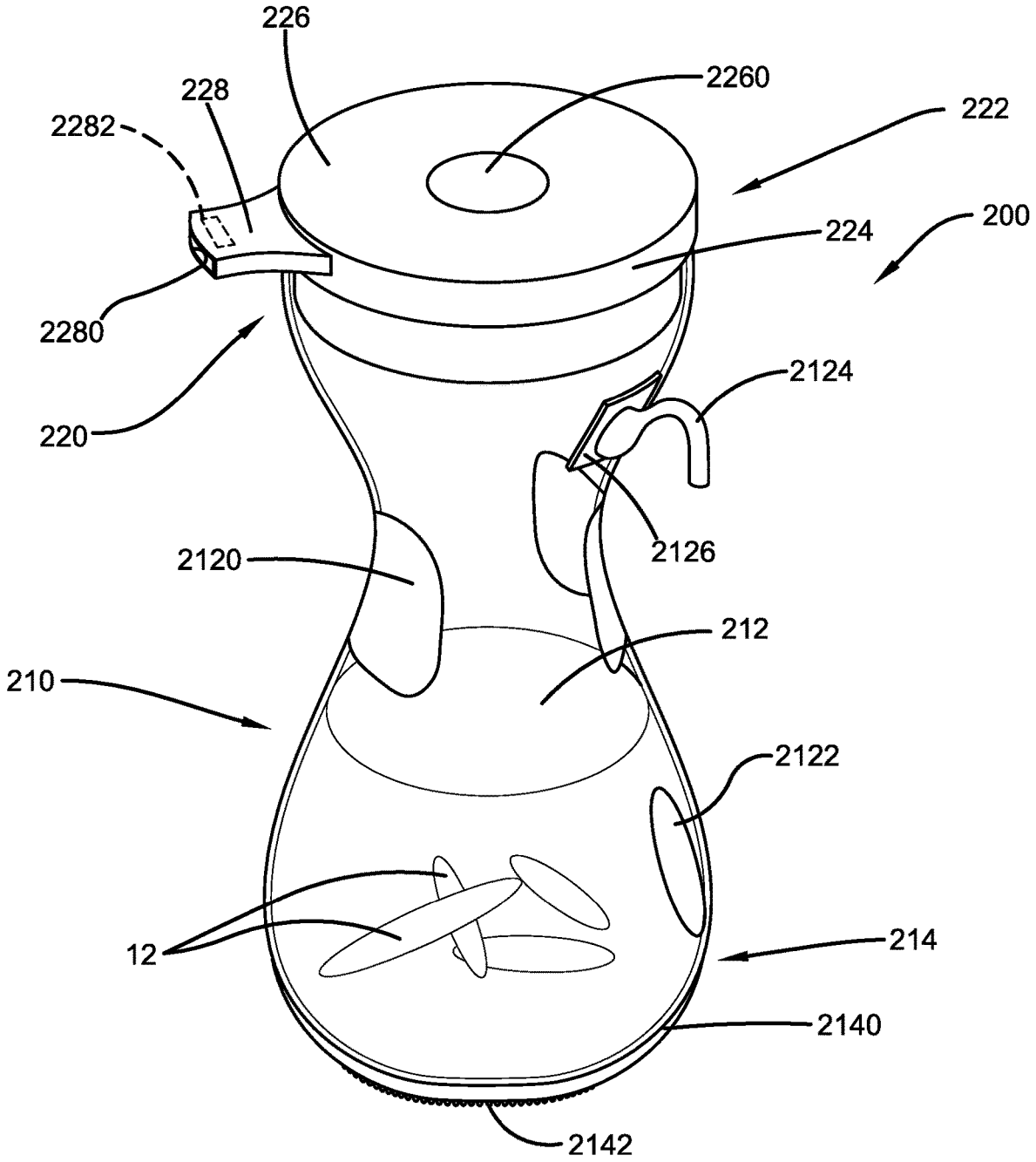
FIG. 2 provides a perspective view of one potential embodiment of a solution dispensing device of the solid cleansing bar reusage system of the present invention in a closed position in accordance with the disclosed specification.

FIG. 2 illustrates a perspective view of one potential embodiment of a soap dispensing device 200 of the solid cleansing bar reusage system 100 of the present invention in a closed position. In this figure, the male lid component 222 can also be observed. The male lid component 222 is preferably round in shape and has a flat top surface 226. The component 222 also has an outer side surface 224 which further includes a spout 228. However, it should be noted that the top surface 226 may alternatively have a spout 228 in one embodiment of the container 200. The spout 228 preferably contains a continuous opening 2280 that allows the liquid cleansing solution 400 to exit the body 210. The continuous opening 2280 of the spout 228 may also have an internal spout gate 2282, which allows or inhibits the flow of the liquid cleansing solution 400 from the body 210. The gate 2282 can be opened or closed via a push button assembly 2260 located on the top surface 226 of the male lid component 222 such that when the assembly 2260 is pressed down, the spout gate 2282 opens and liquid soap 400 may flow from the spout 228. However, when the assembly 2260 is not pressed down, the spout gate 2282 remains closed and the liquid cleansing solution 400 may not flow from the spout 228.

Figure 3:
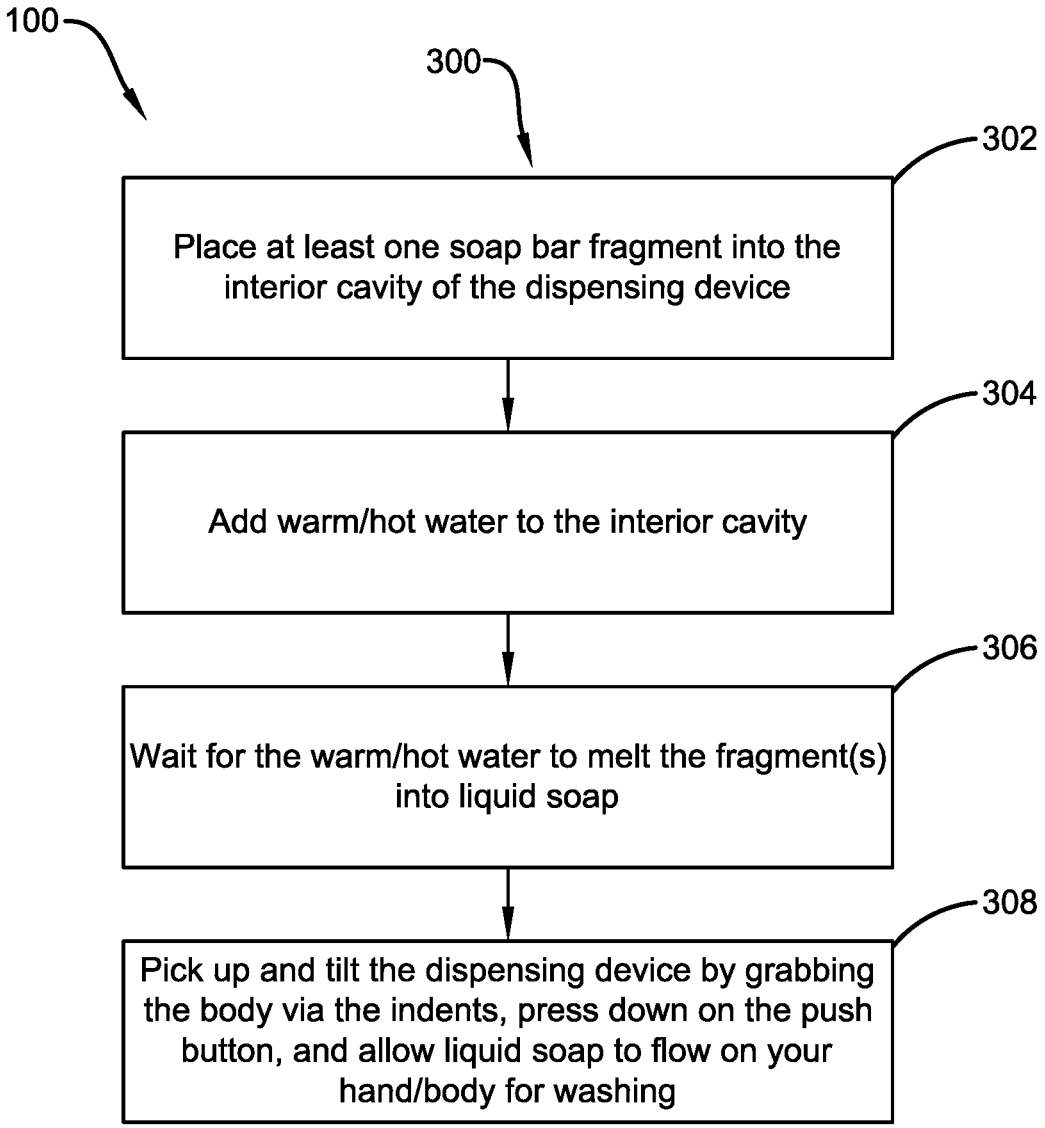
FIG. 3 depicts a graphical representation of one potential embodiment of a method of reusing fragments, bits or pieces of a solid cleansing bar to form the liquid cleansing solution of the soap bar reusage system of the present invention in a closed position in accordance with the disclosed description.

FIG. 3 illustrates a graphical representation of one potential embodiment of a method of reusing a fragment 12 of a solid cleansing bar to for a liquid cleansing solution 400 of the soap bar reusage system 100 of the present invention in a closed position. As noted, the system 100 is designed to allow an individual to utilize a remaining bar fragment or piece 12, such that it need not be thrown away and wasted. Accordingly, the fragment or piece 12 can be turned into a liquid cleansing solution using the method 300 of the system 100. The first step 302 of the method 300 involves placing at least one bar fragment or piece 12 into the interior cavity area or reservoir 240 of the dispensing device 200. The second step 304 of the method then involves adding warm or hot water to the interior cavity 240. In other embodiments, a different liquid may be used as the warming solution, such as essential oils, so that an individual can add other attributes to the cleansing solution.

Alternatively, the heating elements discussed with respect to FIG. 1 may be activated in order to melt the fragments or pieces without the need of adding water or other heated material. Thirdly 306, a user must then wait for the water or other liquid to melt the fragment(s) or pieces 12 into the liquid cleansing solution 400. In the fourth step 308 an individual can then pick up and tilt the dispensing device 200 by grabbing the body 210 via the indents 2120, pressing down the push button 2260 (in an embodiment of the device 200 that is comprised of a push button 2260) and allowing liquid cleansing solution, such as soap 400, to flow onto their hand 10 or body for washing, which can be observed in FIG. 4. Together, waiting for the liquid to melt and pouring the liquid is known as "store and pour". It should also be noted that the interior cavity 240 of the dispensing device 200 may have an agitator 242 that aids in the breakdown of bar fragments or pieces 12 by further breaking down the fragments or pieces 12 if a user chooses to swirl or shake the device 200 after adding hot water.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "soap bar reusage system" and "system" are interchangeable and refer to the soap bar reusage system 100 of the present invention. Further, "soap dispensing device" and "device" refer to the soap dispensing device 200 of the present invention.

Notwithstanding the forgoing, the soap bar reusage system 100 of the present invention and its various components can be of any suitable size and configuration as is known in the art without affecting the overall concept of the invention, provided that they accomplish the above-stated objectives. One of ordinary skill in the art will appreciate that the size, configuration and material of the soap bar reusage system 100 as shown in the FIGS. are for illustrative purposes only, and that many other sizes and shapes of the soap bar reusage system 100 are well within the scope of the present disclosure. Although the dimensions of the soap bar reusage system 100 are important design parameters for user convenience, the soap bar reusage system 100 may be of any size, shape and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A container for upcycling a cleansing bar fragment, the container comprising:

at least one side wall;

a base;

a top;

a reservoir for holding a solution;

a pour spout located in the top of the container, the pour spout having a gate to control a flow of the solution from the container;

an actuator to control the gate;

a plurality of protuberances extending inward from the base and the at least one sidewall for breaking up the cleansing bar fragment; and a suction cup integrated into the at least one side wall.

2. The container as recited in claim 1, wherein the cleansing bar fragments are selected from a soap, a shampoo and a shaving bar fragment.

3. The container as recited in claim 1, wherein the at least one side wall comprises a gripping feature to assist a user in holding the container.

4. The container as recited in claim 1, wherein the top further comprises a male engaging element and a female engaging element to form a closure.

5. The container as recited in claim 4, wherein the male and female engaging elements comprise threads or cooperating snaping elements.

6. The container as recited claim 1 further comprising an agitator for breaking up the cleansing bar fragment.

7. The container as recited claim 1 further comprises a heating element for heating the solution.

8. The container as recited claim 7, wherein the heating element is powered by an electrical outlet.

9. A container and cleansing bar fragment combination comprising:

a container having a reservoir;

a plurality of cleansing bar fragments selected from a soap bar, a shampoo bar and a cleansing bar; and a liquid for melting the plurality of cleansing bar fragments;

a plurality of protuberances positioned within the reservoir.

10. The container and cleansing bar fragment combination as recited in claim 9, wherein the liquid is one of an essential oil or a water.

11. The container and cleansing bar fragment combination as recited in claim 10, wherein the liquid is heated.

12. The container and cleansing bar fragment combination as recited in claim 9, wherein the container comprises at least one of a protuberance or an agitator.

13. The container and cleansing bar fragment combination as recited in claim 9, wherein the container comprises a heating element for heating the liquid.

14. The container and cleansing bar fragment combination as recited in claim 9, wherein the container comprises at least one side wall having a plurality of gripping elements.

15. The container and cleansing bar fragment combination as recited in claim 9, wherein the container comprises a base having a rubberized surface.

16. An upcycling container for personal cleansing products, the upcycling container comprising;

a container having a top, a base and a reservoir for holding a cleansing solution;

a plurality of fragments of solid cleansing bars placed within the reservoir;

a heated liquid placed in the reservoir, wherein the heated liquid is one of a water or an essential oil;

a dispenser on the top of the container;

a plurality of protuberances positioned along the base and on a side wall of the container within the reservoir;

an agitator positioned within the reservoir; and a removable hook attachable to the sidewall via a magnetic plate.

17. The upcycling container as recited in claim 16, wherein the plurality of fragments are selected from a soap bar, a shampoo bar and a shaving bar.

18. The upcycling container as recited in claim 17, wherein the container comprises a heating element.

* * * * *